US006719508B2

(12) United States Patent
Jones et al.

(10) Patent No.: US 6,719,508 B2
(45) Date of Patent: Apr. 13, 2004

(54) RETURNABLE DUNNAGE FOR MACHINED METAL MEMBERS

(75) Inventors: Roosevelt Jones, Battle Creek, MI (US); Mark D. Metzger, Flint, MI (US); Rick J. Strait, Midland, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/079,647

(22) Filed: Feb. 20, 2002

(65) Prior Publication Data

US 2003/0156916 A1 Aug. 21, 2003

(Under 37 CFR 1.47)

(51) Int. Cl.[7] ..... B61D 45/00; B63B 25/24; B65D 85/68

(52) U.S. Cl. ..... 410/155; 206/319

(58) Field of Search ..... 410/31, 32, 43, 410/46, 77, 87, 88, 155; 108/55.3; 206/319, 386, 596, 598, 599

(56) References Cited

U.S. PATENT DOCUMENTS 3,140,672 A * 7/1964 De Luca ..... 108/53.3
3,478,869 A * 11/1969 Walters ..... 206/319
3,580,467 A * 5/1971 Pieszak et al. ..... 206/319
3,717,245 A * 2/1973 Brander et al. ..... 206/422
3,948,190 A * 4/1976 Cook et al. ..... 108/53.3
3,961,707 A * 6/1976 Lehr et al. ..... 206/419
4,610,355 A * 9/1986 Maurer ..... 206/386
4,717,025 A * 1/1988 Maurer ..... 206/599
6,484,877 B1 * 11/2002 Murakami et al. ..... 206/303

* cited by examiner

*Primary Examiner*—D. Glenn Dayoan
*Assistant Examiner*—Paul Chenevert
(74) *Attorney, Agent, or Firm*—L. J. Kasper

(57) ABSTRACT

A returnable dunnage assembly (25) for a machined metal member, such as a cylinder head (11) includes a relatively rigid plastic tray (27) and received therein, a relatively flexible, conformable plastic insert member (29). The insert member (29) has an internal profile (43) configured to be in engagement with a lower portion external profile (13) of the cylinder head (11) over at least a major portion thereof. The insert member (29) is removably disposed within the tray (27) and the fit of the insert member (29) within the tray (27) is such that the cylinder head (11) is accurately located relative to the tray, and can be inserted into, or removed from the tray by automated material handling means. The insert member (29) comprises a plastic material, such as a polyurethane, such that during movement of the dunnage assembly (25), the vibration will not cause the machined cylinder head to "shave" material from the insert member (29), which would then require a subsequent cleaning operation, prior to assembly of the cylinder head into the complete engine.

6 Claims, 6 Drawing Sheets

RETURNABLE DUNNAGE FOR MACHINED METAL MEMBERS

BACKGROUND OF THE DISCLOSURE

The present invention relates to a returnable dunnage assembly for use in shipping a relatively complex, machined metal member, and more particularly, to such a dunnage assembly which is suitable for use in "over the highway" shipment of such machined members.

As is used herein, the term "returnable" in regard to the dunnage assembly of the present invention will be understood to mean that the dunnage assembly may be returned, for example, to the original point of shipment of the machined member, and the assembly may then be reused subsequently for shipping additional, identical machined members. As is well know to those skilled in the art, it is essential that dunnage of the type to which the present invention relates be reusable a number of times, in order to spread the cost of the dunnage assembly over a number of parts, thus reducing the total cost of shipment attributable to each machined part.

Although the present invention would have application in connection with the shipment of many types of manufactured items, it is especially advantageous when used in connection with the shipment of relatively complex, machined metal castings, and will be described in connection therewith. Furthermore, but by way of example only, the present invention was developed in connection with a need to ship machined cylinder heads, for assembly as part of internal combustion engines, and will be described in connection therewith. Conventionally, machined cylinder heads (whether cast iron or cast aluminum) have been shipped to various locations within the particular engine plant in relatively rigid plastic containers, with each cylinder head being somewhat loosely received within the container (also sometimes and hereinafter referred to as a "tray"). Typically, the tray might be configured to hold a number of cylinder heads, for example, four cylinder heads in one tray.

Such plastic trays have been generally satisfactory when the cylinder heads were merely being shipped within a single engine plant, or within an engine plant complex. However, it has been found that the use of such trays is not acceptable in situations in which the cylinder head is machined at a first location, and is then shipped from that first location to a second location, such as the engine assembly plant, wherein the containers of cylinder heads must be shipped a long distance over-the-highway, typically by truck.

Among the problems associated with the over-the-highway shipment of machined cylinder heads, using the plastic trays intended only as in-plant dunnage, is that the heads are permitted to move within the plastic tray, and the various sharp edges defined by the machined surfaces engage, or make contact with, interior surfaces of the plastic tray and generate plastic shavings, shaved from the tray, as the tray vibrates during over-the-highway shipment. The problem with the generation of plastic shavings during shipment is not primarily the potential damage to the plastic tray, although that could eventually become a problem. Instead, the immediate, and greater problem with the generation of plastic shavings during shipment is that such shavings tend to adhere to the machined member, and in particular, tend to adhere to the machined surfaces. Thus, when the cylinder head is received at the engine assembly plant, it is necessary to wash the cylinder head, or in some other way remove the shavings, before the head is assembled to the engine block. Such an additional process step, which is not normally necessary when the head is merely being shipped in-plant, is undesirable because it represents additional handling of the cylinder head, and therefore, additional cost of assembly of the engine.

It is also known to ship machined metal members, such as cylinder heads, by wrapping the members in a sort of plastic "shrink wrap" packing material. Although such a packing material may be effective in eliminating the problem of the generation of plastic shavings, such a packing/dunnage arrangement for cylinder heads is not acceptable, primarily because, once the cylinder head and packing material combination is received in the engine assembly plant, the cylinder heads must first be unpacked and then placed within in-plant dunnage for subsequent handling. This again adds an additional, otherwise unproductive, operation or step which is undesirable.

As is well know to those skilled in the engine assembly art, the major parts of an engine, such as the cylinder block and the cylinder head(s), are typically handled by assembly robots in the engine assembly plant. Therefore, any dunnage assembly used for shipping the cylinder heads should preferably be designed such that, once the dunnage assembly is within the assembly plant, an assembly robot can grasp the cylinder head and lift it out of a dunnage tray, without any preparatory steps being required, other than sensing the location of the tray. This objective requires that the cylinder head be very accurately located within the tray. For example, the location of the cylinder head within the tray must be within the range of about +/−0.015 inches relative to the tray, in order for the assembly robot to be able to grasp the head, on a consistent, repeatable basis.

Another known, prior art dunnage arrangement which has been used for shipping engine cylinder heads involves an outer, tray-like member which is a bolted-together assembly of a number of different members. The outer member receives and supports a number of individual support members, each of which is bolted to the outer member. The support members are plastic members, molded from the same type of relatively rigid, plastic material as has been used typically for the prior art trays. Thus, if the above-described dunnage arrangement is utilized for over-the-highway shipment, it is likely that the "shavings" problem will occur, but in this case, the shavings would be removed from the individual support members, rather than from the outer tray. In addition, the rigid support members, bolted to the rigid outer member, are not likely to provide both the desired anti-vibration support and the accurate location for purposes of employing the assembly robot.

BRIEF SUMMARY OF THE INVENTION

Accordingly, it is an object of the present invention to provide a returnable dunnage assembly especially adapted for shipping relatively complex, machined metal members which will overcome the above-described problems of the prior art.

It is a more specific object of the present invention to provide such a dunnage assembly which will permit over-the-highway shipment (or some other type of shipment which results in substantial vibration) without the resulting vibration causing the generation of plastic shavings from the container in which the machined member is immediately disposed.

It is a more specific object of the present invention to provide a dunnage assembly which accomplishes the abovestated objects, while at the same time being capable of positioning the machined metal member very accurately within the outer container, thus being adaptable to the use of automated material handling equipment.

The above and other objects are accomplished by the provision of a returnable dunnage assembly for a relatively complex, machined metal member having a particular, lower portion external profile. The dunnage assembly includes a relatively rigid container defining an internal configuration larger than the lower portion external profile of the member.

The dunnage assembly is characterized by a relatively flexible, conformable insert member removably disposed within the internal configuration of the container and having an external configuration closely spaced apart within the internal configuration of the container. The insert member defines an internal profile configured to be in engagement with the lower portion external profile over at least a major portion thereof, as that term will be defined subsequently. The insert member comprises a material operable to withstand being in engagement with the machined metal member during movement of the dunnage assembly without the engagement causing the generation of shavings from the insert member.

In accordance with another aspect of the invention, the dunnage assembly is characterized by the fit of the external configuration of the insert member within the internal configuration of the container, and the fit of the lower portion external profile within the internal profile of the insert member being within a relatively narrow tolerance to facilitate insertion of the machined member into, or removal from the container by automated material handing means.

DETAILED DESCRIPTION OF THE PREFERRED EMBODIMENT

Figure 1:
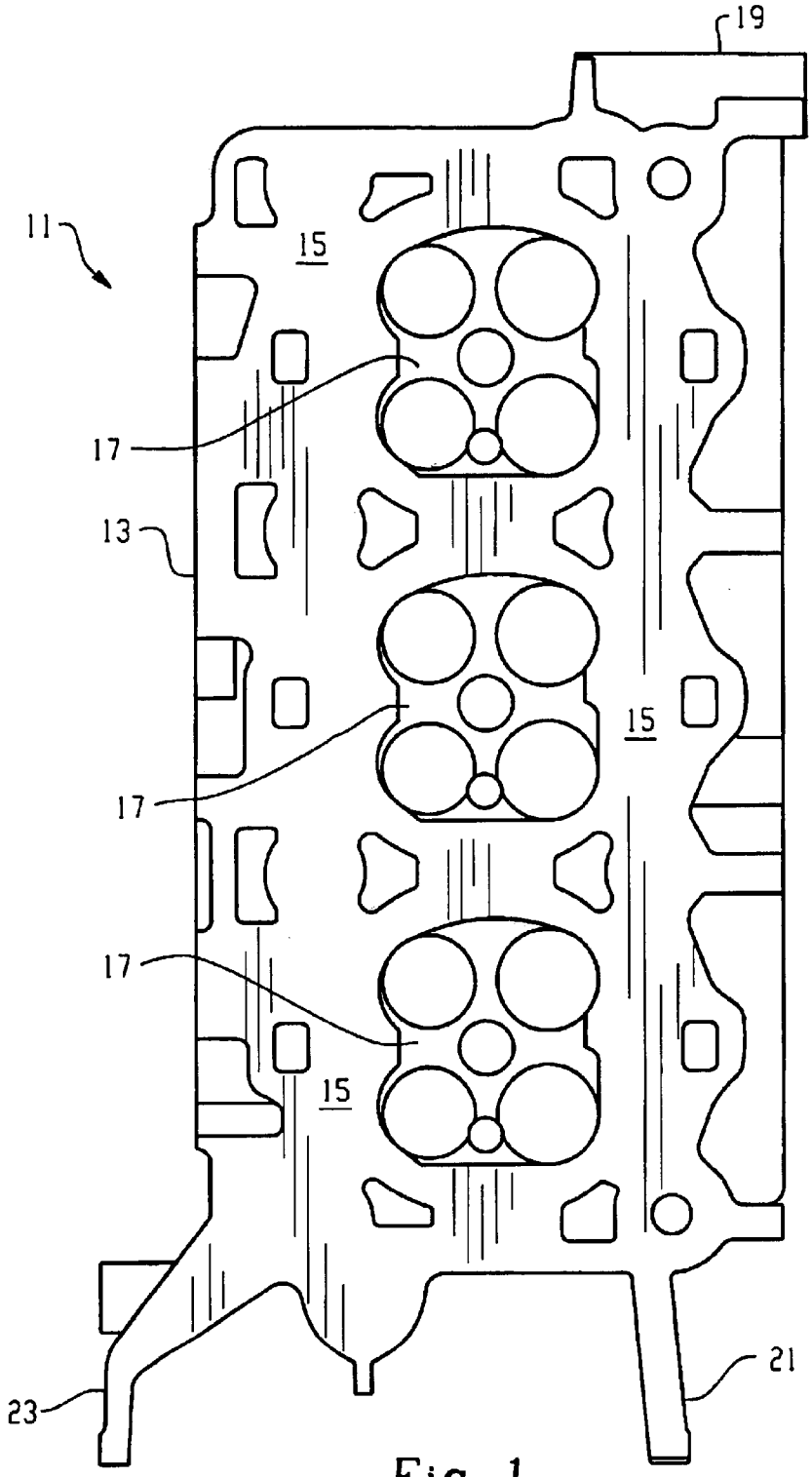
FIG. 1 is a bottom plan view of a machined cylinder head which, by way of example only, is to be transported in the returnable dunnage assembly of the present invention.

Referring now to the drawings, which are not intended to limit the invention, FIG. 1 illustrates a bottom plan view of a cast aluminum, machined cylinder head, generally designated 11. It should be understood by those skilled in the art of dunnage that the cylinder head 11 is being shown herein by way of example only, i.e., as an example of a machined metal member which could be transported using the returnable dunnage assembly of the present invention. Also, the cylinder head 11 is being shown as an example because the head 11 is a relatively complex shape, and the configuration of the head 11 determines the configuration of the dunnage, i.e., the dunnage is custom designed for the member to be transported within the dunnage.

The cylinder head 11 defines a lower portion external profile, generally designated 13, which is defined in part as the outer periphery of a combustion face 15. As is well known to those skilled in the engine art, the combustion face 15 (which is the "bottom" surface of the head 11 when in assembled position) is disposed in engagement with an upper surface of an engine block (not shown herein). In the subject embodiment, the engine block would be for a V-6 engine, such that the cylinder head 11 defines three recessed areas 17, each being disposed at the upper end of a cylinder when the engine is assembled. As is used herein, the term "recessed" in regard to the areas 17 means that each area 17 is recessed to be above the plane of the combustion face 15 when the head 11 is in its normal, upright orientation.

The present invention is especially advantageous when used in connection with a machined member which is non-symmetrical, and as may best be seen in FIG. 1, the lower portion external profile 13 of the cylinder head 11 is clearly non-symmetrical, and very irregular, such that the head 11 may be placed in the returnable dunnage of the present invention in only one correct orientation. Thus, the cylinder head 11 includes, as part of its external profile 13, a series of unique structural features 19, 21 and 23 to which subsequent reference will be made. For purposes of describing the present invention, the particular shape of the structural features 19, 21 and 23 is not important, but instead, what is important is that the dunnage assembly be designed and configured to accommodate such features.

Figure 2:
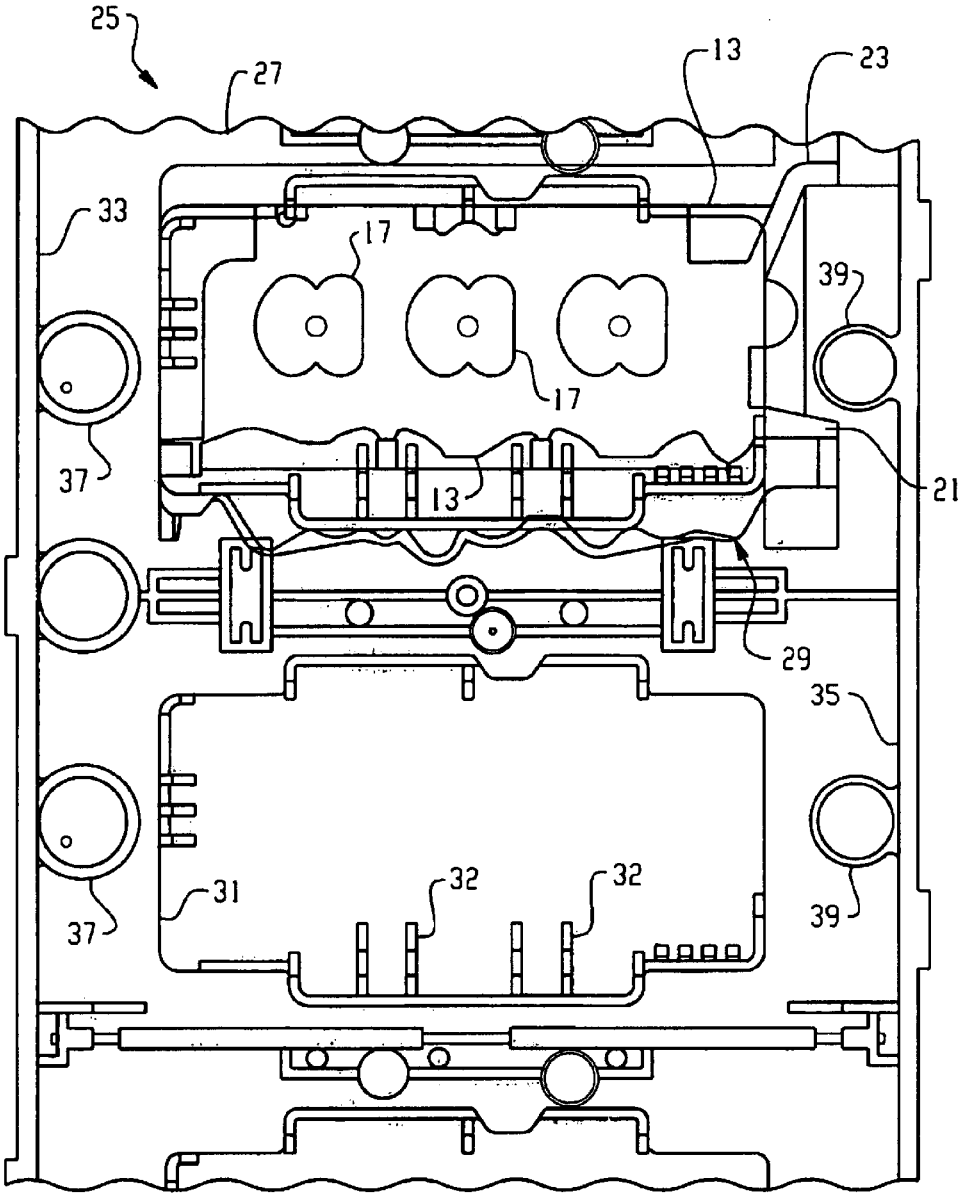
FIG. 2 is a fragmentary, top plan view, looking downward into a container or tray which comprises part of the dunnage assembly of the present invention, and which has disposed therein one of the inserts which contains the cylinder head shown in FIG. 1.

Referring now primarily to FIG. 2, there is illustrated a fragmentary, top, plan view of a dunnage assembly, generally designated 25, made in accordance with the present invention. The dunnage assembly 25 includes a container 27, also referred to herein as a "tray", and disposed within the tray 27 is a plurality of insert members 29, although for simplicity, only one insert 29 is shown in FIG. 2. Although not an essential feature of the invention, it would normally be preferred for economic reasons to include a plurality of insert members 29 and cylinder heads 11 within each tray 27, and in the subject embodiment, the tray 27 can accommodate four of the insert members 29 within each tray 27. Therefore, during shipment, each tray 27 will contain four machined cylinder heads 11, and typically, although not shown herein, a number of the trays 27 will be "palletized" or placed together on a single pallet, which may be moved by any suitable means, such as by a fork lift truck, as is well known in the art.

In accordance with one important aspect of the invention, the tray 27 defines four substantially identical internal configurations, generally designated 31 (although there are only two present in the fragmentary view of FIG. 2), each of which receives one of the insert members 29. The internal configuration 31 of the tray 27 may be defined in part by a series of inwardly projecting ribs 32 which will engage some portion of the outer profile (to be described further subsequently) of the insert 29. Alternatively, and probably preferably, the ribs 32 may be eliminated, and the internal configuration 31 may conform over most of its extent to be in direct engagement with the outer profile of the insert 29. It should be noted in FIG. 2 that each internal configuration 31 is non-symmetrical, as is the lower portion external profile 13 of the cylinder head 11.

The tray 27 includes side walls 33 and 35, and formed integrally therewith are support columns 37 and 39, respectively, such that one of the trays 27 can be stacked on top of another tray, in a manner well known in the container art, during the palletizing process referred to above, and which forms no part of the present invention. Preferably, the tray 27 is molded from a relatively rigid plastic material, such as a polypropylene of the type now commonly used, such that each of the internal configurations 31 is relatively rigid, for reasons which will become apparent subsequently.

Figure 3:
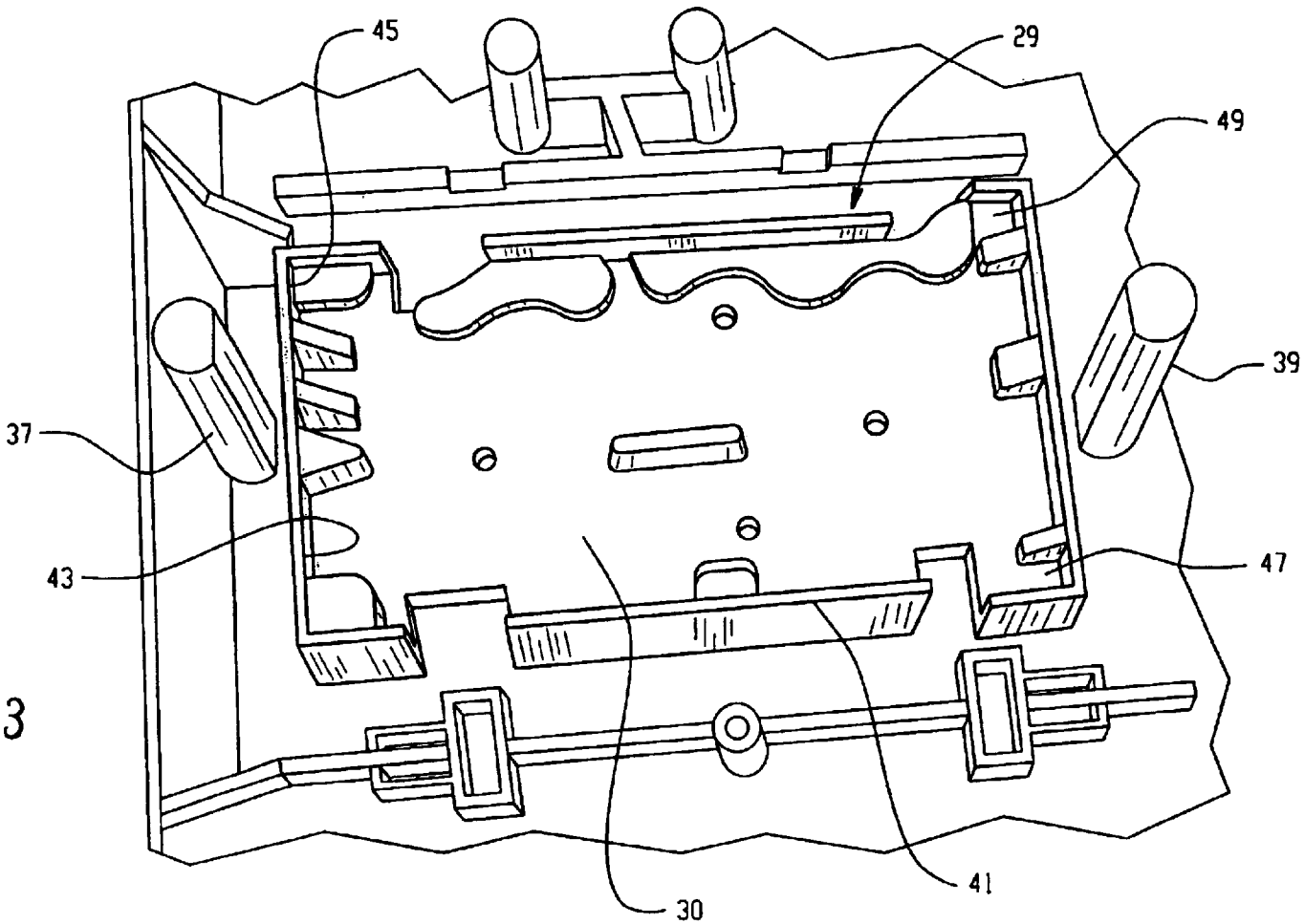
FIG. 3 is a perspective view, similar to FIG. 2, and on about the same scale, and showing a single insert surrounded by certain of the structural features of the container or tray.
Figure 3A:
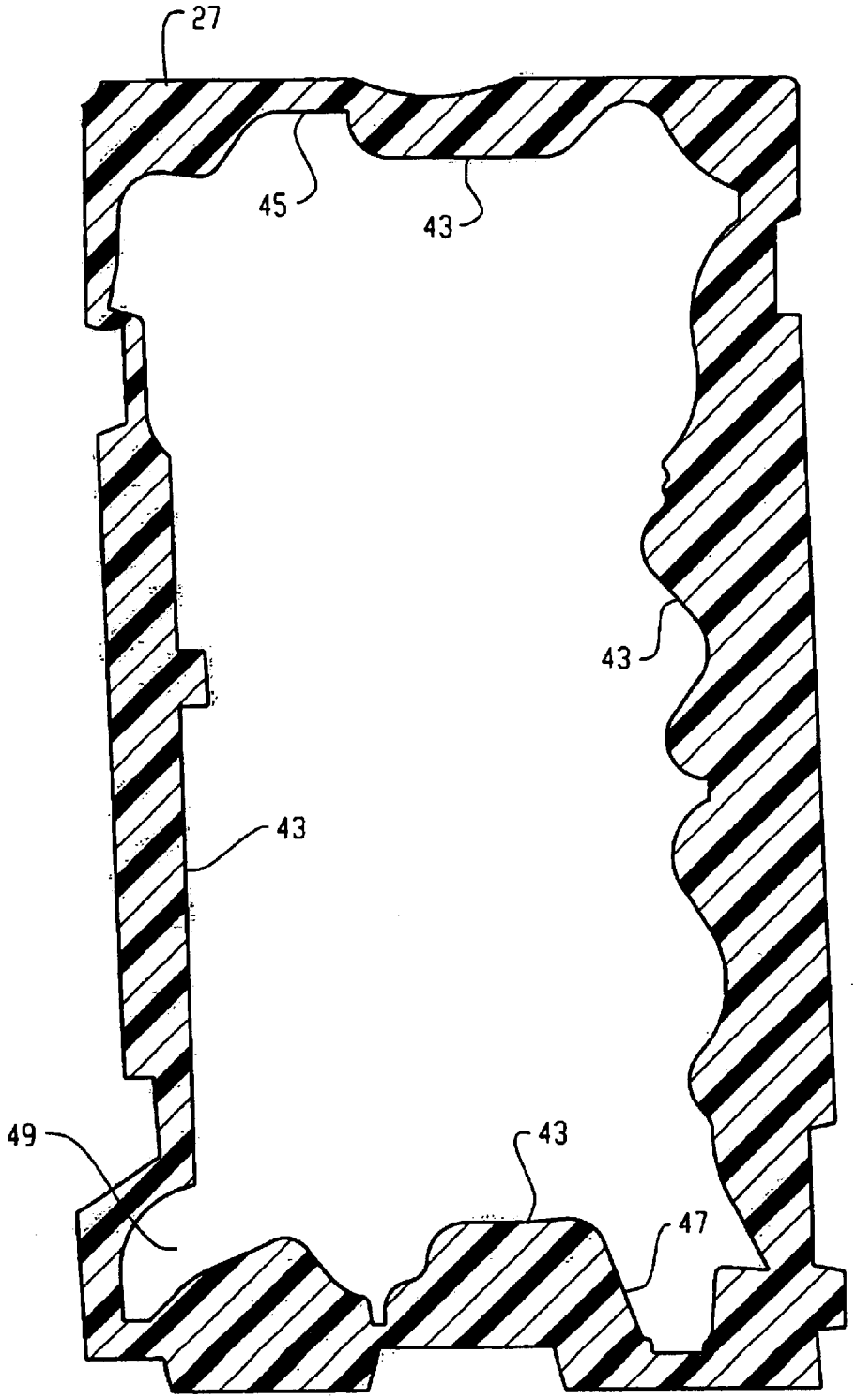
FIG. 3A is a horizontal cross-section, viewed looking upwardly, of the insert shown in perspective view in FIG. 3, with FIG. 3A being on a somewhat larger scale than FIG. 3, and taken on a section just above the bottom of the insert.

Referring now primarily to FIGS. 3 and 3A, each of the insert members 29 comprises an injection molded, relatively flexible, conformable member defining an external configuration, generally designated 41. Preferably, the external configuration 41 is closely spaced within the respective internal configuration 31 defined by the tray 27, and described in connection with FIG. 2. By "relatively flexible" as used herein in regard to the insert member 29, it is meant that the insert member 29 should be flexible relative to the tray 27, which was referred to as "relatively rigid". Thus, as each insert member 29 is installed in its location within the internal configuration 31, it is the insert member 29 which may change shape slightly rather than the tray 27. Similarly, as the cylinder head 11 is placed within the insert member 29, it will be the insert member 29 which changes shape slightly and conforms to the external profile 13 of the cylinder head 11.

The insert member 29 defines an internal profile, generally designated 43, and which conforms to, or is in engagement with, the lower portion external profile 13 of the cylinder head 11 over at least a major portion thereof. Therefore, and by way of example only, the internal profile 43 includes a number of sections 45, 47, and 49 which receive and support the unique structural features 19, 21, and 23, respectively, of the cylinder head 11. As was mentioned previously, the sections 45, 47, and 49 are shown by way of example only, to correspond to the features 19, 21, and 23, and if the machined member to be shipped were of a different configuration, there would be different unique features, and therefore, different unique sections defined by the insert member.

As used herein, and in the appended claims, the term "at least over a major portion thereof", in reference to the engagement of the external profile 13 of the machined member within the internal profile 43 of the insert member 29, can have either of several meanings. First, and as is shown in the preferred embodiment, the term can mean that the external profile 13 engages the internal profile 43 in the manner of a "glove fit", being in contact with each other over substantially the entire surface area of the internal profile 43, as the cylinder head 11 is lowered into the insert member 29. Secondly, the term can mean that there are a fairly large number of points of contact between the external profile 13 and the internal profile 43, with the collective contact serving to provide sufficient support so that the cylinder head 11 does not move substantially during shipment.

In connection with the second meaning of the term, it is preferred, but not essential, that the placing of the cylinder head 11 within the insert member 29 actually causes a bit of stretching of the molded insert member, thus insuring very good engagement therebetween, although over less total area of contact than in the case of the first embodiment. In the case of either embodiment, it is important that the external configuration 41 of the insert member 29 fit closely enough within the internal configuration 31 of the tray 27, and that the external profile 13 fit closely enough within the internal profile 43, such that the cylinder head 11 is located within a relatively narrow tolerance, relative to the tray 27. Therefore, as was mentioned in the BACKGROUND OF THE DISCLOSURE, it will be possible to insert the cylinder head into, or remove it from, the tray 27 by means of automated material handling equipment, which must be able to engage and grip the head 11 based only on sensing the location of the tray 27.

By way of example only, during the development of the present invention, it was found to be effective to use a tray 27 made from a plastic material having a durometer in the range of about 110 to about 140 on the Shore A scale, while using an insert member 29 made from a plastic material having a durometer in the range of about 80 to about 100 on the Shore A scale. Thus, it is believed that one skilled in the art will understand the meanings of the terms "relatively flexible" and "relatively rigid", in regard to the insert member 29 and the tray 27, respectively, based upon the example durometers provided above.

Figure 4:
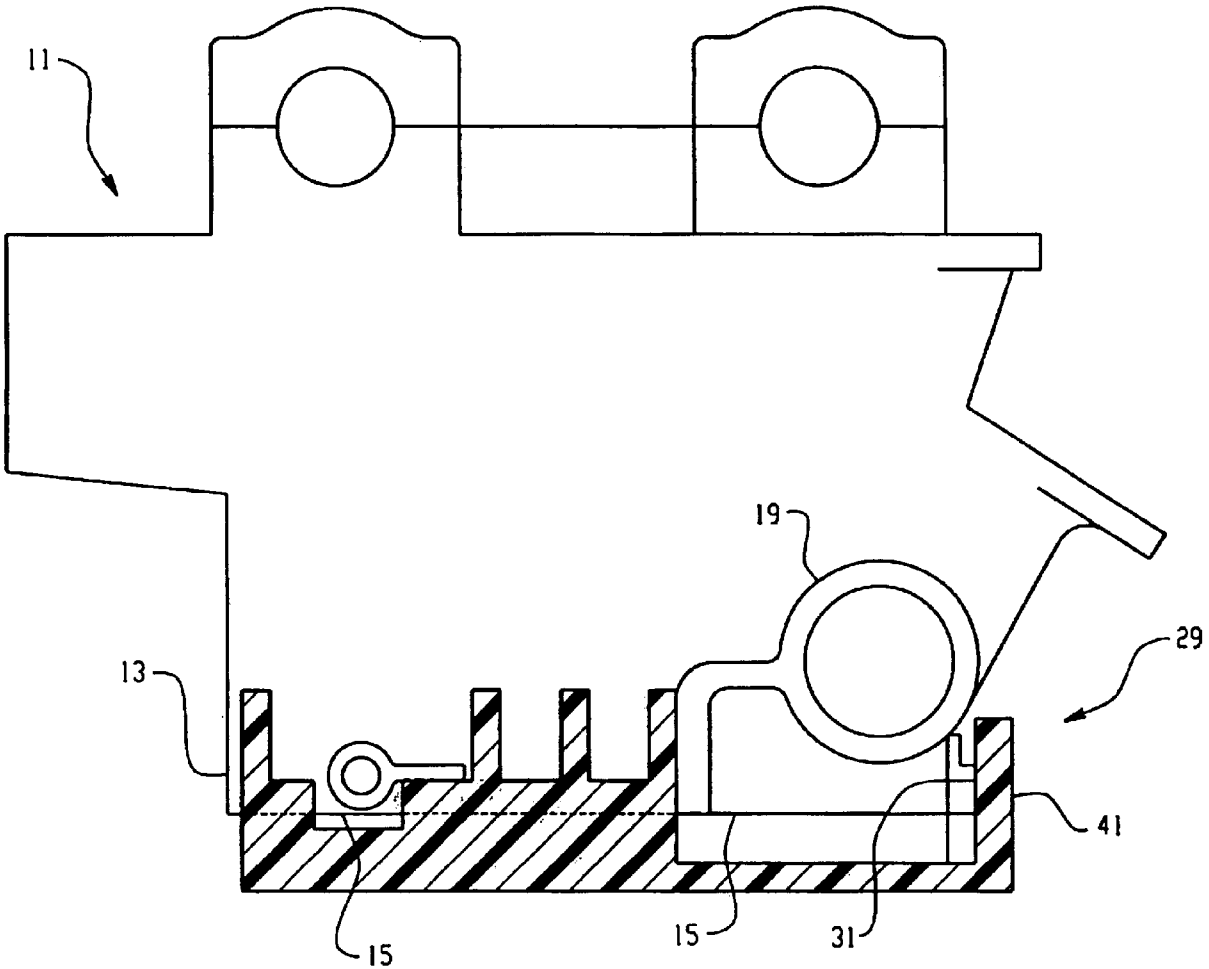
FIG. 4 is a somewhat schematic end view of the cylinder head shown in FIG. 1, showing an end view of the insert of the present invention, with the insert being shown partly in end view and partly in transverse cross-section.

As may best be seen in FIG. 4, it is preferred in the subject embodiment of the invention that the combustion face 15 of the cylinder head 11 be maintained up above the bottom surface of the insert member 29, partly to avoid even the possibility of shavings being generated and accumulated on the combustion face 15. As was mentioned in the BACKGROUND portion of this specification, any shavings which accumulate on a machined surface would have to be washed away, or in some other manner removed, before assembly cylinder head with the remainder of the engine. FIG. 4 also illustrates, on the left hand side thereof, that even within the scope of this invention, there may be certain locations wherein the external profile 13 of the head 11 is clearly not in engagement with an adjacent portion of the internal configuration 31 of the insert member 29.

Figure 5:
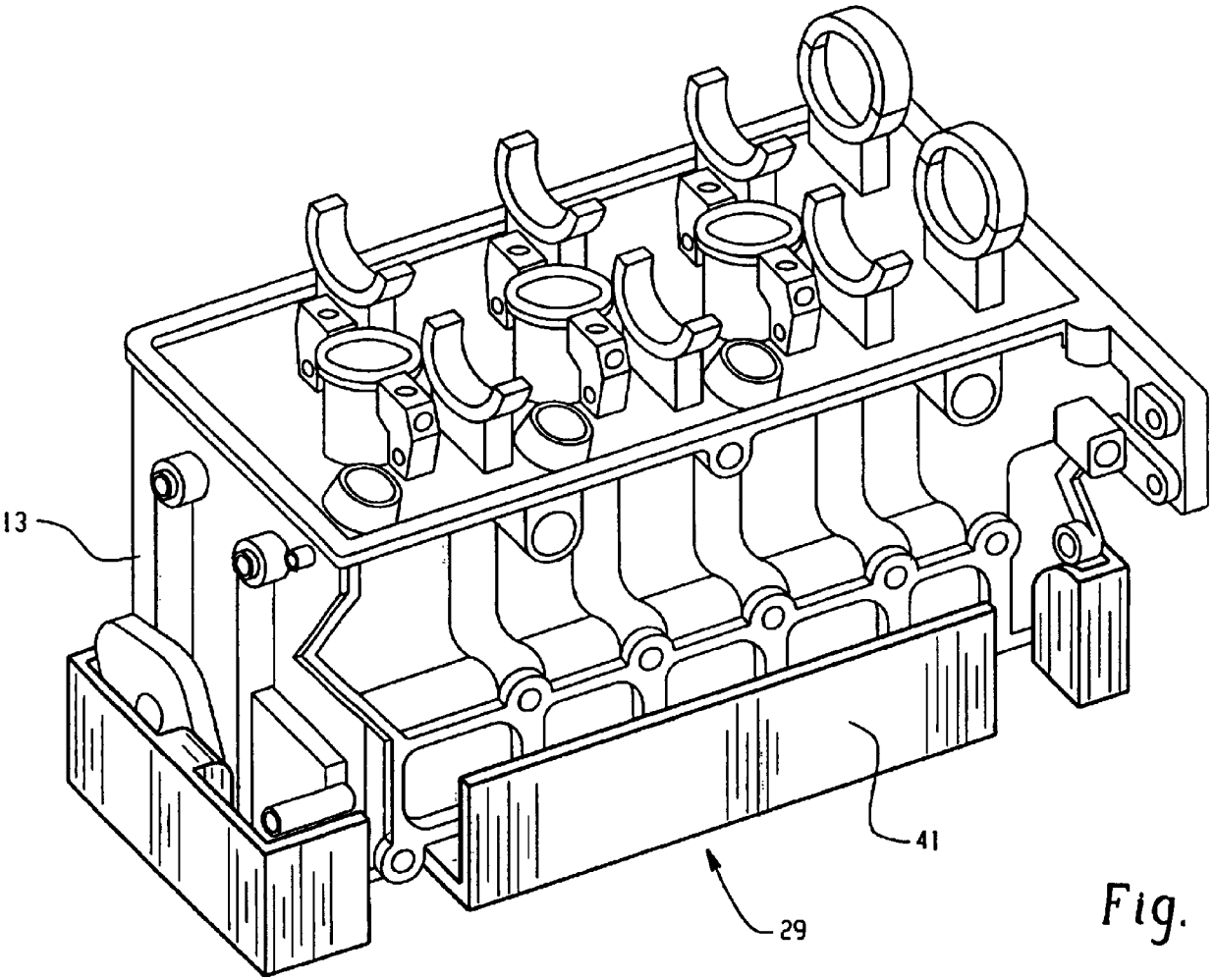
FIG. 5 is a perspective view of a machined cylinder head received within the insert, without the container, the fit between the head and the insert comprising one important aspect of the present invention.

Referring now primarily to FIG. 5, this view is included mainly to help illustrate the manner in which the lower portion external profile 13 of the head 11 is received within the insert member 29. However, those skilled in the art will understand that the invention is in no way limited to a dunnage assembly 25 in which the particular portion of the machined member is received within the insert, but within the scope of the invention, either a greater or a lesser portion of the external profile of the machined member could be received within the insert member 29.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A returnable dunnage assembly for a relatively complex, machined metal member having a particular, lower portion external profile, said dunnage assembly including a relatively rigid container defining an internal configuration larger than said lower portion external profile of the machined member the metal member being non-symmetrical and having one desired unique, correct orientation within said container; characterized by:

(a) a relatively flexible, conformable insert member, removably disposed within said internal configuration of said container, and having an external configuration closely spaced within said internal configuration of said container;

(b) said insert member defines an internal profile configured to be in engagement with said lower portion external profile over at least a major portion thereof;

(c) said insert member comprising a material operable to withstand being in engagement with said machined metal member during movement of said dunnage assembly without said engagement causing the generation of shavings from said insert member.

2. A returnable dunnage assembly as claimed in claim 1, characterized by the fit of said external configuration of said insert member within said internal configuration of said container, and the fit of said lower portion external profile within said internal profile of said insert member is within a relatively narrow tolerance to facilitate insertion of the machined member into, or removal from, said container by automated material handling means.

3. A returnable dunnage assembly as claimed in claim 1, characterized by said internal configuration of said container and said external configuration of said insert member including unique features operable to insure said desired orientation of said machined member within said container, and said insert member including unique sections corresponding to said unique features.

4. A returnable dunnage assembly as claimed in claim 1, characterized by said container comprising a relatively rigid, generally non-conformable plastic material having a durometer in the range of about 110 to about 140 on the Shore A scale, and said insert member comprising a relatively high density polyurethane material having a durometer in the range of about 80 to about 100 on the Shore A scale.

5. A returnable dunnage assembly as claimed in claim 1, characterized by said container defines a plurality N of said internal configurations, adapted to receive a plurality N of said insert members, whereby the container contains a plurality N of the machined members, said container being configured to prevent contact between adjacent machined members during movement of said dunnage assembly.

6. A returnable dunnage assembly for a relatively complex, machined metal member having a particular, lower portion external profile, said dunnage assembly including a relatively rigid container defining an internal configuration larger than said lower portion external profile of the machined member characterized by:

(a) a relatively flexible, conformable insert member, removably disposed within said internal configuration of said container, and having an external configuration closely spaced within said internal configuration of said container;

(b) said insert member defines an internal profile configured to be in engagement with said lower portion external profile over at least a major portion thereof;

(c) said insert member comprising a material operable to withstand being in engagement with said machined metal member during movement of said dunnage assembly without said engagement causing the generation of shavings from said insert member; and (d) the machined metal member comprises a cylinder head for use on an internal combustion engine, the head including, on its lower portion, a machined combustion face, said insert member including a bottom, internal surface and means operable to maintain the combustion face spaced apart from said bottom, internal surface of said insert member.

* * * * *